US008391765B2

(12) United States Patent
Kanai et al.

(10) Patent No.: US 8,391,765 B2
(45) Date of Patent: Mar. 5, 2013

(54) FIXING DEVICE AND IMAGE FORMING APPARATUS

(75) Inventors: Kenji Kanai, Ebina (JP); Masakatsu Eda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 303 days.

(21) Appl. No.: 12/951,570

(22) Filed: Nov. 22, 2010

(65) Prior Publication Data

US 2011/0236092 A1 Sep. 29, 2011

(30) Foreign Application Priority Data

Mar. 29, 2010 (JP) ..... 2010-074389

(51) Int. Cl.
*G03G 15/20* (2006.01)

(52) U.S. Cl. ..... 399/331; 399/332

(58) Field of Classification Search ..... 399/328–332, 399/338

See application file for complete search history.

(56) References Cited

FOREIGN PATENT DOCUMENTS

JP 07-319314 A 12/1995
JP 08-012526 A 1/1996

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

A fixing device includes: a rotating member supporting section supporting a first rotating member rotatably and movable in direction in which the first rotating member approaches and leaves a second rotating member; a compression spring pushing the rotating member supporting section in the direction of approaching the second rotating member; and a pressing member pressing the compression spring to the rotating member supporting section. The device further includes: a first spring contact member contacting the compression spring and movable in a compression-and-expansion direction of the compression spring relative to the rotating member supporting section; a first adjustment screw adjusting a position of the first spring contact member; a second spring contact member contacting the compression spring and movable in a direction inclined to the compression-and-expansion direction, relative to the pressing member; and a second adjustment screw adjusting a position of the second spring contact member relative to the pressing member.

8 Claims, 9 Drawing Sheets

FIXING DEVICE AND IMAGE FORMING APPARATUS

CROSS-REFERENCE TO RELATED APPLICATION

This application is based on and claims priority under 35 USC 119 from Japanese Patent Application No. 2010-074389, filed Mar. 29, 2010.

BACKGROUND (i) Technical Field

The present invention relates to a fixing device and an image forming apparatus.

(ii) Related Art

As a fixing device that fixes a toner image formed on a recording medium, there is known a fixing device that includes a mechanism for pressing a pressing roller against a pressing roller and a mechanism for adjusting a compression length of a spring to adjust pressing force.

Further, there is known a fixing device that includes a device that adjusts the position of a pressing roll with respect to a heating roll.

SUMMARY

A fixing device includes:

a first rotating member that extends along a rotation center line and rotates around the rotation center line;

a second rotating member that extends side by side with the first rotating member, sandwiches in cooperation with the first rotating member a recording medium on which a toner image is formed, and rotates together with the first rotating member to thereby fix the toner image on the recording medium;

a rotating member supporting section that supports the first rotating member in a state in which the first rotating member is rotatable, the rotating member supporting section being movable in a direction in which the first rotating member moves close to and away from the second rotating member;

a compression spring that pushes, with repulsion force against compression, the rotating member supporting section in the direction in which the first rotating member moves close to the second rotating member;

a pressing member that presses the compression spring to the rotating member supporting section and compresses the compression spring;

a first spring contact member that is set in contact with one end of the compression spring and movable in a compression and expansion direction of the compression spring with respect to the rotating member supporting section to which force received from the compression spring is transmitted;

a first adjustment screw that adjusts a position of the first spring contact member with respect to the rotating member supporting section;

a second spring contact member that is set in contact with the other end opposed to the one end of the compression spring and movable in an inclined direction, which is inclined with respect to the compression and expansion direction of the compression spring, with respect to the pressing member that receives force transmitted from the pressing member and pushes the compression spring with the force transmitted from the pressing member; and a second adjustment screw that adjusts a position of the second spring contact member with respect to the pressing member.

BRIEF DESCRIPTION OF THE DRAWINGS

An exemplary embodiment of the present invention will be described in detail based on the following figures, wherein.

DETAILED DESCRIPTION

An embodiment of the present invention will be described below with reference to the accompanying drawings.

Figure 1:
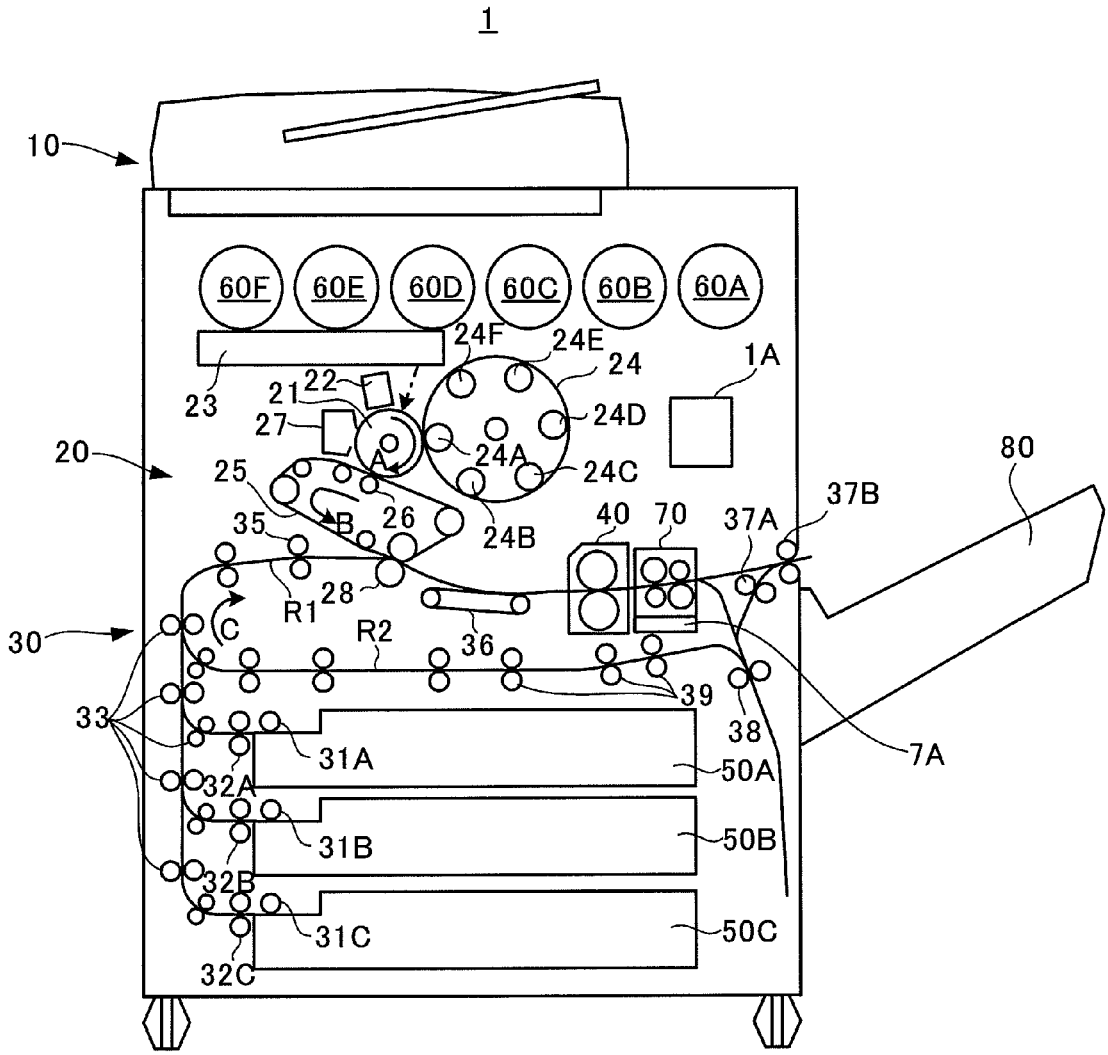
FIG. 1 is a diagram of a schematic configuration of a copying machine that is a first embodiment of an image forming apparatus according to the present invention.

FIG. 1 is a diagram of a schematic configuration of a copying machine that is a first embodiment of the image forming apparatus according to the present invention.

A copying machine 1 shown in FIG. 1 includes an image reading unit 10 that reads an image from an original document, a toner image forming unit 20 that forms a toner image on a sheet, a sheet conveying unit 30 that conveys the sheet, a fixing device 40 that fixes a toner on the sheet, and a control unit 1A that controls each unit of the copying machine 1. The copying machine 1 also includes sheet storing units 50A, 50B, and 50C that store sheets and toner storing devices 60A, 60B, 60C, 60D, 60E, and 60F that store toners of six colors used for formation of an image. The sheet conveying unit 30 extracts a sheet from the sheet storing units 50A, 50B, and 50C and conveys the sheet through a conveying path R1 that passes through the toner image forming unit 20. The image reading unit 10 reads an image from an original document and generates image data. The toner image forming unit 20 forms, based on the image data generated by the image reading unit 10, an image on the sheet conveyed by the sheet conveying unit 30.

The toner image forming unit 20 includes: a photosensitive drum 21 on the surface of which an electrostatic latent image and a toner image are formed and that rotates in an arrow A direction in the figure, a charging device 22 that charges the photosensitive drum 21, and an exposing unit 23 that receives input of image data, irradiates the photosensitive drum 21 with exposure light modulated based on the image data, and forms an electrostatic latent image. The toner image forming unit 20 further includes: a developing unit 24 that gives a toner to the electrostatic latent image and forms a toner image, an intermediate transfer belt 25 that comes into contact with the photosensitive drum 21 and revolves and moves in an arrow B direction in the figure, and a primary transfer roll 26 that primarily transfers the toner image formed on the photosensitive drum 21 onto the intermediate transfer belt 25. The toner image forming unit 20 further includes: a photosensitive cleaning device 27 that cleans the photosensitive drum 21 after the primary transfer, and a secondary transfer device 28 that secondarily transfers the toner image, which is primarily transferred onto the intermediate transfer belt 25, onto a sheet conveyed by the sheet conveying unit 30 from the sheet storing units 50A, 50B, and 50C. The fixing device 40 heats and presses the toner image transferred onto the sheet to thereby fix the toner image on the sheet. The copying machine 1 also includes: a warp correcting device 70 that corrects a warp of the sheet having the toner image fixed thereon, and a stacking tray 80 on which the sheet having an image formed thereon is laid.

In the developing unit 24, six developing devices 24A, 24B, 24C, 24D, 24E, and 24F respectively corresponding to six colors including four colors CMYK and two special colors are incorporated. In the developing devices 24A to 24F, two-component developers including toners of the colors and a carrier are stored. The developing unit 24 sequentially rotates 60 degrees at a time, and thereby development by the toners of CMYK and the special colors is performed and toner images of the colors are formed. The toner images of the colors are superimposed one on top of another when being transferred onto the intermediate transfer belt 25 by the primary transfer roll 26 and a full-color toner image is formed. The full-color toner image is transferred onto a sheet by the secondary transfer device 28. The toners of the colors are supplied to the six developing devices 24A to 24F from the toner storing devices 60A to 60F.

The sheet conveying unit 30 conveys a sheet along the conveying path R1 and a front and rear reversing path R2. The sheet conveying unit 30 includes: extracting rolls 31A, 31B, and 31C that extract sheets from the sheet storing devices 50A, 50B, and 50C; sorting rolls 32A, 32B, and 32C that sort the sheets; a conveying roll 33 that conveys each of the sorted sheets; and a registration roll 35 that feeds the sheet into the secondary transfer device 28 according to timing when the secondary transfer device 28 transfers a toner image. The sheet conveying unit 30 further includes: a belt conveying device 36 that conveys the sheet from the secondary transfer device 28 to the fixing device 40 while attracting the sheet; output rolls 37A and 37B that output the sheet to the outside of the copying machine 1; a switching and conveying roll 38 that switches the direction of the conveyance of the sheet and conveys the sheet; and a duplex conveyance roll 39 that conveys, for duplex printing, the sheet along the front and rear reversing path R2.

The sheets stored in the sheet storing devices 50A to 50C are extracted by the extracting rolls 31A to 31C and sorted by the sorting rolls 32A to 32C. Each of the sorted sheets is conveyed by the conveying roll 33 on the conveying path R1 in an arrow C direction in the figure. Thereafter, the sheet is fed into the secondary transfer device 28 by the registration roll 35 and the toner image is transferred onto the sheet. The sheet is conveyed to the fixing device 40 by the belt conveying device 36 and a toner is fixed on the sheet. Thereafter, a warp of the sheet is corrected by the warp correcting device 70. The sheet is output by the output rolls 37A and 37B and laid on the stacking tray 80.

When the duplex printing is executed in the copying machine 1, the sheet conveying unit 30 conveys a sheet along the front and rear reversing path R2 branching from the conveying path R1 and returning to the conveying path R1, and causes the sheet halfway to move in the reverse direction at a point in the front and rear reversing path R2, to thereby reverse the sheet upside down. More specifically, the sheet having passed through the warp correcting device 70 is conveyed in the reverse direction by switching of a conveying direction by the switching and conveying roll 38 while being conveyed by the switching and conveying roll 38. Subsequently, the sheet is conveyed in an arrow D direction in the figure along the front and rear reversing path R2 by the duplex conveyance roll 39. The sheet conveyed through the front and rear reversing path R2 returns to the conveying path R1 and passes through the conveying roll 33 and the registration roll 35 again. A toner image is transferred by the secondary transfer device 28 onto the rear surface, i.e., a surface on which the toner image is not transferred yet.

The control unit 1A controls the operation of each unit of the copying machine 1.

The fixing device 40 of the copying machine 1 is provided to be freely drawn out from the copying machine 1 to the front side of the copying machine 1. More specifically, a slider 7A that can be freely drawn out to the front side is provided in a main body of the copying machine 1. The fixing device 40 is attached on the slider 7A.

Figure 2:
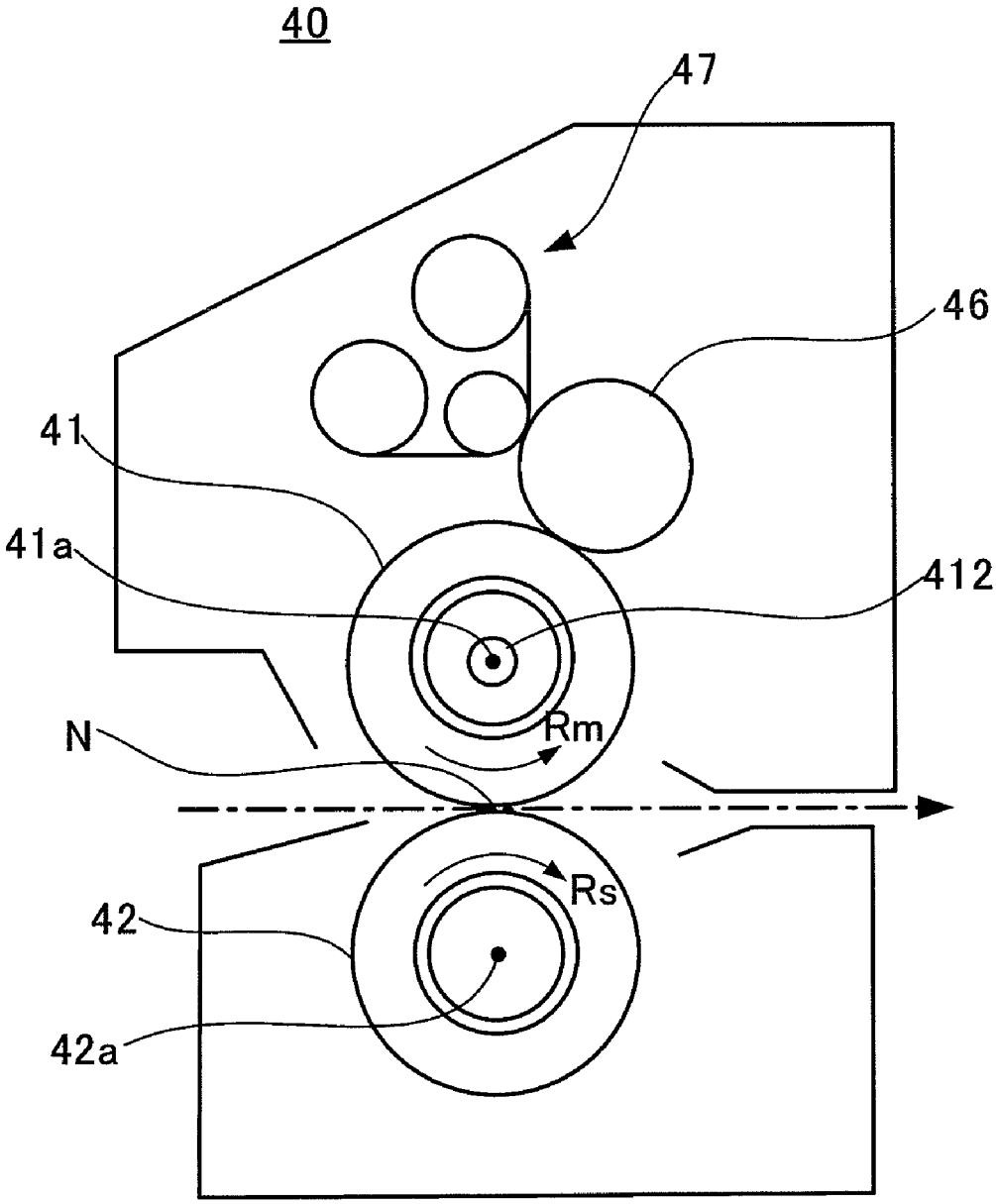
FIG. 2 is a diagram of a schematic configuration of a fixing device shown in FIG. 1.

FIG. 2 is a diagram of a schematic configuration of the fixing device shown in FIG. 1.

The fixing device 40 includes a heating roll 41 and a pressing roll 42. Circumferential surfaces of the heating roll 41 and the pressing roll 42 are set in contact with each other. More specifically, the pressing roll 42 is pressed against the heating roll 41 by a pressing mechanism 43 (see FIG. 3) that will be described later. A nip region N for nipping a sheet is formed between the heating roll 41 and the pressing roll 42. The heating roll 41 and the pressing roll 42 have not-shown elastic layers of rubber. The elastic layers are elastically deformed by pressing force and surfaces for nipping the sheet are formed in the nip region N. The width of the nip region N is changed depending on the pressing force of the pressing roll 42 exerted by the pressing mechanism 43.

The heating roll 41 has a cylindrical shape. A halogen lamp 412 is disposed in the inside of the heating roll 41 as a heat source. Further, the fixing device 40 includes an external heating roll 46 that is in contact with the circumferential surface of the heating roll 41 and heats the heating roll 41 from the outer side and a cleaning device 47 that wipes the circumferential surface of the external heating roll 46 with a web to thereby clean the circumferential surface.

Driving force is transmitted to the heating roll 41 from a not-shown driving motor. The heating roll 41 rotates in an arrow Rm direction around a rotation center 41*a*. In response to the rotation of the heating roll 41, which is in contact with the pressing roll 42, the pressing roll 42 rotates in an arrow Rs direction around a rotation center 42*a*. A sheet fed into the fixing device 40 is nipped by the heating roll 41 and the pressing roll 42 in the nip region N and conveyed. A toner image on the sheet at this point is brought into contact with the heating roll 41 and heated. Pressure by pressing force for pressing the pressing roll 42 against the heating roll 41 is applied to the toner image, and thereby the toner image is fixed on the sheet.

Here, the pressing roll 42 is equivalent to an example of the first rotating member in the present invention. The heating roll 41 is equivalent to an example of the second rotating member in the present invention.

Figure 3:
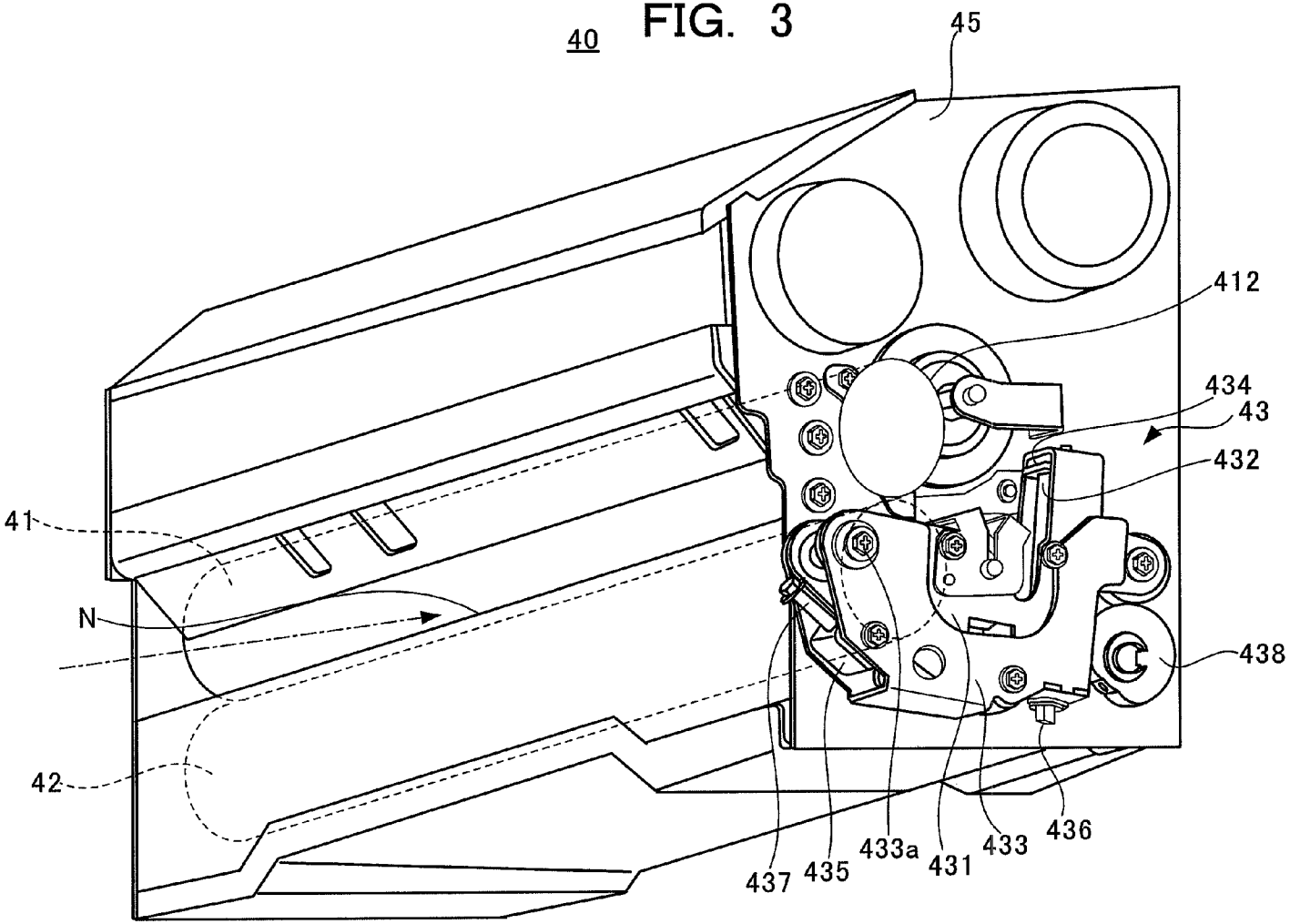
FIG. 3 is a perspective view of the fixing device shown in FIG. 2.

FIG. 3 is a perspective view of the fixing device shown in FIG. 2. FIG. 3 illustrates the fixing device 40 viewed from below in the front of the copying machine 1 in a posture in which the fixing device 40 is mounted on the copying machine 1.

The pressing roll 42 and the heating roll 41 of the fixing device 40 extend side by side as indicated by a broken line in FIG. 3. The fixing device 40 includes pressing mechanisms 43 that support the pressing roll 42 and press the pressing roll 42 to the heating roll 41. The pressing mechanisms 43 are provided on both sides of the fixing device 40. However, one pressing mechanism 43 arranged on the front side in the copying machine 1 is shown in FIG. 2.

Figure 4:
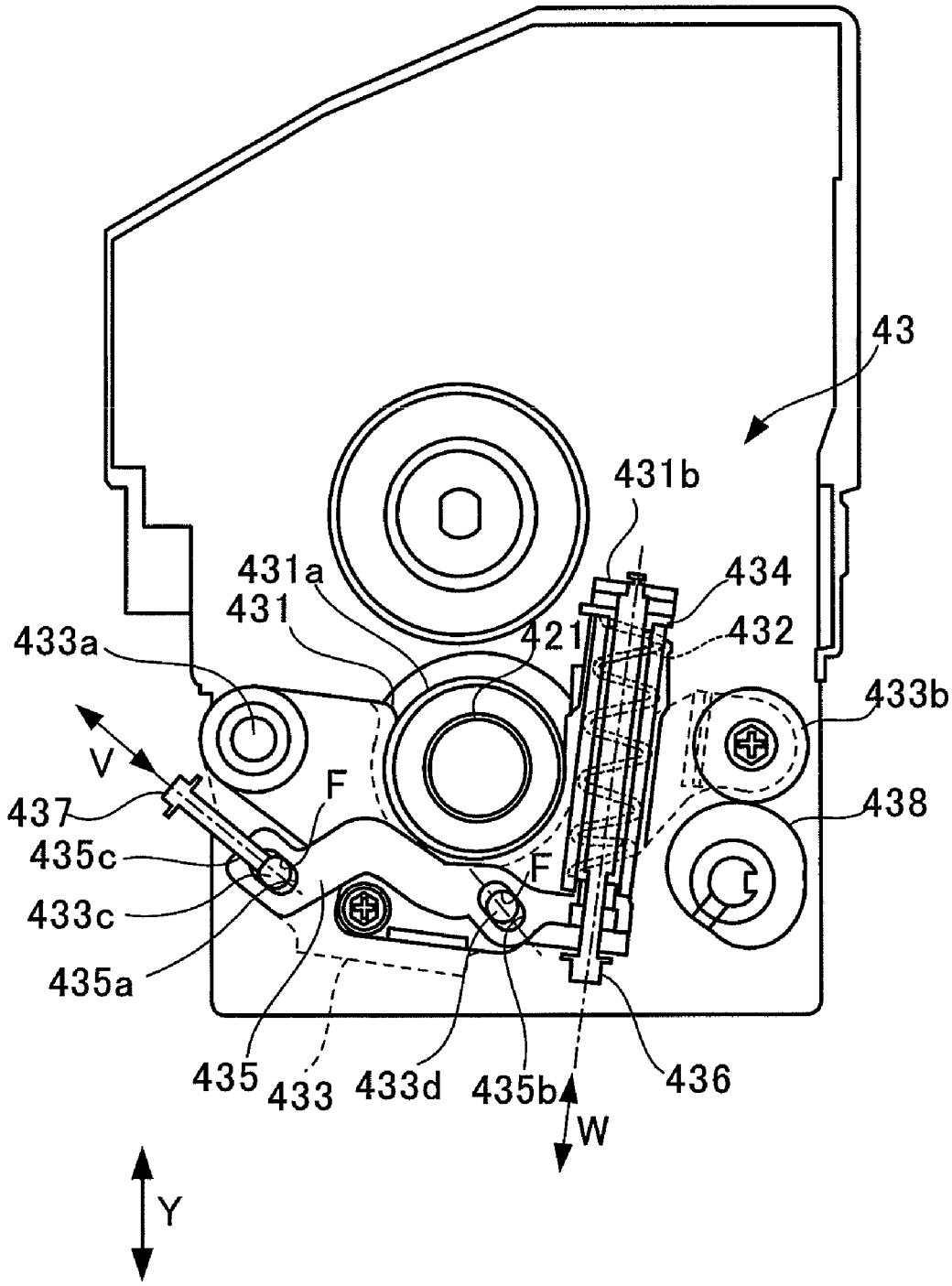
FIG. 4 is a longitudinal sectional view of a pressing mechanism shown in FIG. 3.

FIG. 4 is a longitudinal sectional view of the pressing mechanism shown in FIG. 3. FIG. 4 illustrates a longitudinal section passing through the inside of the pressing mechanism 43 shown in FIG. 3.

The pressing mechanism 43 will be described with reference to both FIGS. 3 and 4.

The pressing mechanism 43 includes a rotating member supporting section 431 that supports the pressing roll 42, a compression spring 432 that presses the rotating member supporting section 431, a pressing member 433 that compresses the compression spring 432, a first spring contact member 434 and a second spring contact member 435 set in contact with both ends of the compression spring 432, a first adjustment screw 436 and a second adjustment screw 437 that adjust pressing force, and a cam 438.

In particular, as shown in FIG. 3, the pressing member 433 is a member formed by bending a metal plate. One end of the pressing member 433 is supported by a rotating shaft 433*a* fixed to a frame 45. The pressing member 433 is rotatable around the rotating shaft 433*a*. The rotating member supporting section 431 that supports the pressing roll 42 is arranged on the inner side of the pressing member 433 formed by bending the metal plate. The pressing member 433 in FIG. 4 is entirely indicated by a broken line to be distinguished from the rotating member supporting section 431.

Figure 5:
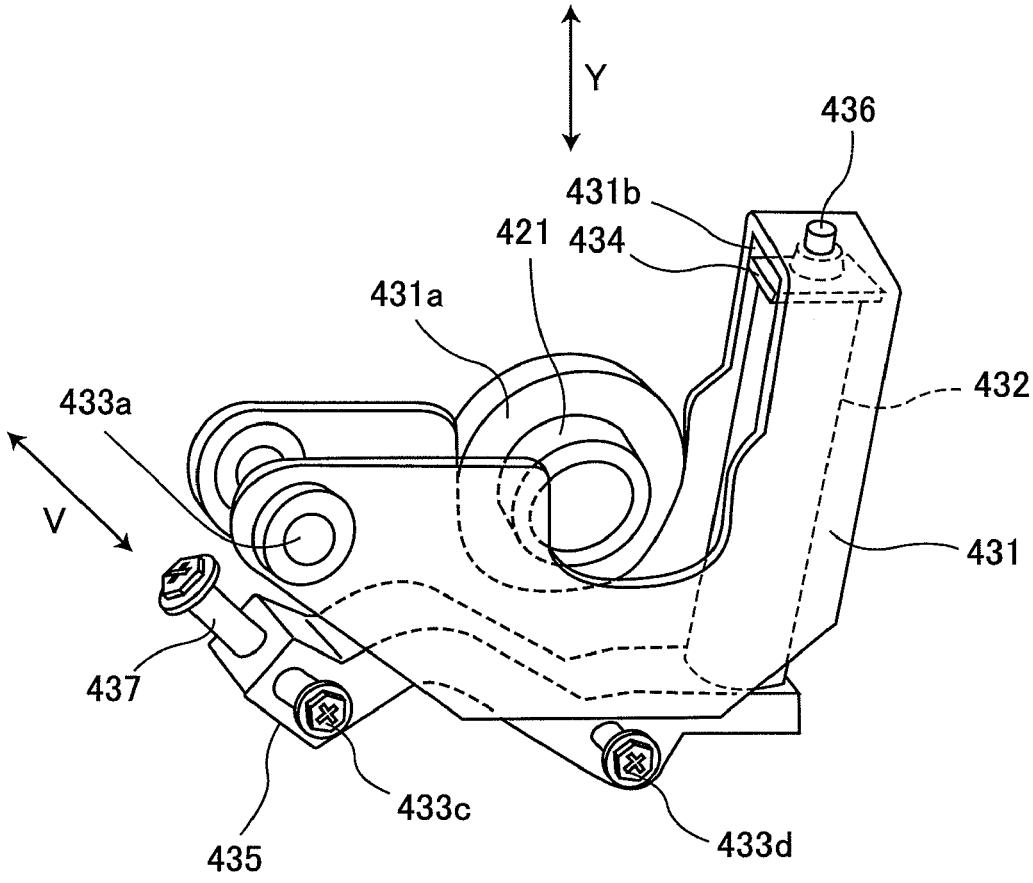
FIG. 5 is a perspective view of an entire rotating member supporting section 431.

FIG. 5 is a perspective view of the entire rotating member supporting section 431. FIG. 5 illustrates the rotating member supporting section 431 entirely exposed by removing the pressing member 433 from the pressing mechanism 43 shown in FIG. 3 and members around the rotating member supporting section 431.

The rotating member supporting section 431 is a member formed by bending a metal plate. Like the pressing member 433, one end of the rotating member supporting section 431 is supported by the rotating shaft 433*a*. The rotating member supporting section 431 is rotatable around the rotating shaft 433*a* in a range of an angle set in advance. The rotating member supporting section 431 and the pressing member 433 are rotatable independently from each other. A bearing member 431*a* that supports a rotating shaft 421 of the pressing roll 42 (see FIG. 3) is fixed to the rotating member supporting section 431. The rotating member supporting section 431 rotatably supports the pressing roll 42 (see FIG. 3) via the bearing member 431*a*. A first screw holding section 431*b* is provided on the opposite side of the rotating shaft 433*a* across the bearing member 431*a* of the rotating member supporting section 431.

The rotating member supporting section 431 rotates around the rotating shaft 433*a* to thereby move the pressing roll 42 supported by the bearing member 431*a* in a vertical direction Y in which the pressing roll 42 moves close to and away from the heating roll 41 (see FIG. 3).

As shown in FIG. 4, a roll 433*b* is rotatably held at an end on the opposite side of the rotating shaft 433*a* across the bearing member 431*a* of the pressing member 433. The roll 433*b* is a cam follower that receives force from the cam 438. When the cam 438 receives driving force of a not-shown motor and rotates, the pressing member 433 rotates around the rotating shaft 433*a* to move up and down.

The pressing member 433 is pushed up by the cam 438 to compress the compression spring 432. The compression spring 432 pushes, with repulsion force against the compression, the rotating member supporting section 431 in a direction in which the pressing roll 42 moves close to the heating roll 41. A state in which the cam 438 pushes up the pressing member 433 to the maximum will be referred to as a pressing state. A direction in which the compression spring 432 is compressed and expanded will be referred to as a compression and expansion direction W. When the cam 438 rotates and changes to a posture in which the push-up of the pressing member 433 is minimized, the compression of the compression spring 432 is released and the pressing roll 42 moves away from the heating roll 41.

Both ends of the compression spring 432 are not in direct contact with the rotating member supporting section 431 and the pressing member 433. An end on the upper side of the compression spring 432 is set in contact with the first spring contact member 434 and an end on the lower side is set in contact with the second spring contact member 435.

The first spring contact member 434 is a nut in which an internal thread is formed. The first adjustment screw 436 is screwed into the first spring contact member 434. The first adjustment screw 436 is arranged in the coil-like compression spring 432 along the compression and expansion direction W. In the first adjustment screw 436, a thread is formed at a pitch of the M6 standard. A distal end of the first adjustment screw 436 is held by the rotating member supporting section 431. The first adjustment screw 436 is held in a state in which the first adjustment screw 436 is rotatable with respect to the first screw holding section 431*b*. The first adjustment screw 436 also pierces through the second spring contact member 435 and the pressing member 433. However, the first adjustment screw 436 is not joined by screwing to the second spring contact member 435 and the pressing member 433. When the first adjustment screw 436 rotates, the position of the first spring contact member 434 with respect to the first screw holding section 431*b* is adjusted. The first screw holding section 431*b* receives repulsion force against the compression from the compression spring 432. The force is transmitted from the first screw holding section 431*b* to the first screw holding section 431*b* via the first adjustment screw 436.

As shown in FIGS. 4 and 5, the second spring contact member 435, with which the end on the lower side of the compression spring 432 is set in contact, is held by the pressing member 433 to be movable in an inclined direction V inclined with respect to the compression and expansion direction W of the compression spring 432. More specifically, two long holes 435*a* and 435*b* are formed in the pressing member 433. Two pins 433*c* and 433*d* fixed to the pressing member 433 are pierced through the long holes 435*a* and 435*b*. Major axes of the long holes 435*a* and 435*b* of the pressing member 433 are formed to extend in the inclined direction V. Surfaces of the long holes 435*a* and 435*b* extending in the inclined direction V are cam surfaces F. In the pressing member 433, a screw hole 435*c* connected to the long hole 435*a* is formed in the inclined direction V. The second adjustment screw 437 is screwed into the screw hole 435*c*. In other words, the second adjustment screw 437 extends in the inclined direction V. The distal end of the second adjustment screw 437 abuts against the pin 433*c*.

A part of force received by the second spring contact member 435 is transmitted to the second adjustment screw 437. The distal end of the second adjustment screw 437 is pressed against the pin 433*c* by the part of the force. The remaining force of the force received by the second spring contact member 435 is directly transmitted from the long holes 435*a* and 435*b* to the pins 433*c* and 433*d*. A thread at a pitch of the M4 standard smaller than the pitch of the thread of the first adjustment screw 436 is formed in the second adjustment screw 437.

When the second adjustment screw 437 rotates, the second spring contact member 435, in which the second adjustment screw 437 is inserted, moves along the cam surface F extending in the inclined direction V. In other words, the second spring contact member 435 moves in the inclined direction V with respect to the pressing member 433. At this point, the second spring contact member 435 moves in the compression and expansion direction W by a component in the compression and expansion direction W oblique to the inclined direction V in a movement amount in the inclined direction V. Highly accurate adjustment by a cam mechanism is performed by a simple structure in which the pins 433*c* and 433*d* guide the second spring contact member 435 in the inclined direction V along the cam surfaces F.

A compression amount of the compression spring 432 in the pressing state is adjusted by the adjustment of the position of the first spring contact member 434 by the first adjustment screw 436 and the adjustment of the position of the second spring contact member 435 by the second adjustment screw 437. The compression amount of the compression spring 432 is adjusted, thereby repulsion force, i.e., pressing force of the pressing roll 42 pressing the heating roll 41, is adjusted. The compression amount of the compression spring 432 is adjusted by a simple structure in which the distal end of the first adjustment screw 436 screwed in the first spring contact member 434 is held in a rotatable state by the rotating member supporting section 431.

Figure 6:
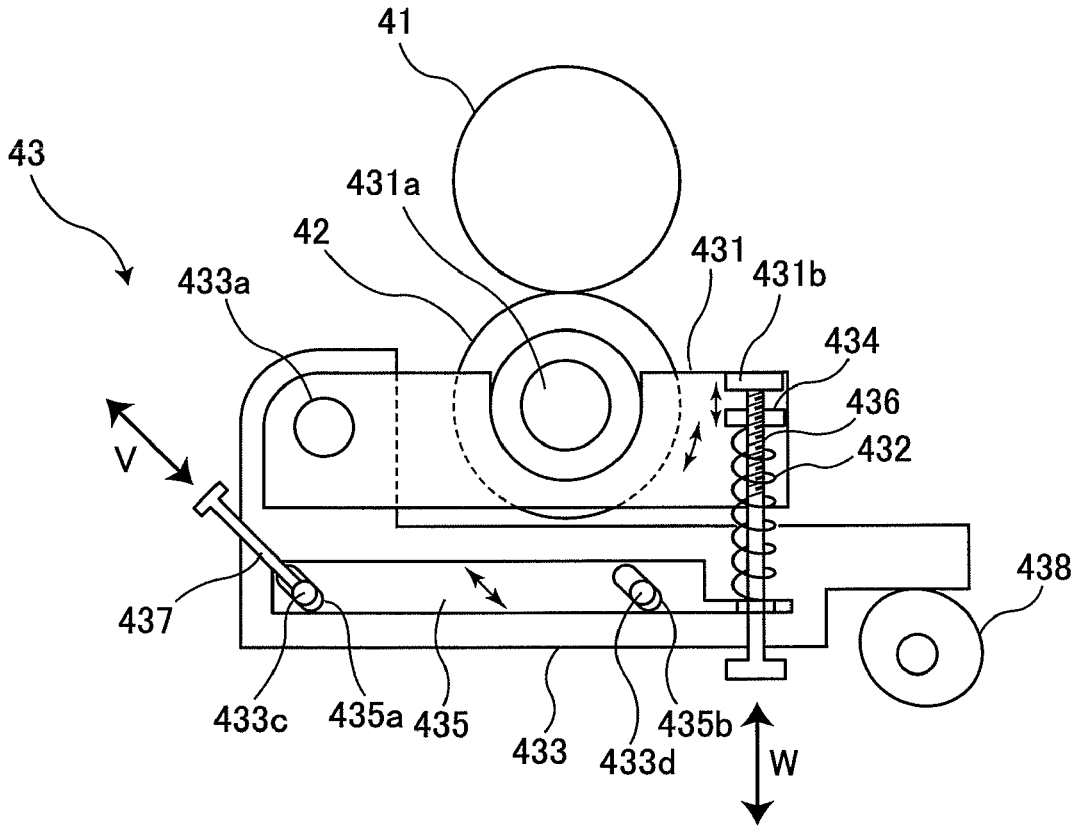
FIG. 6 is a schematic diagram of units of the pressing mechanism shown in FIGS. 3 to 5.

FIG. 6 is a schematic diagram of each unit of the pressing mechanism shown in FIGS. 3 to 5. In FIG. 6, the units are transformed and simplified to be schematically shown so that the functions are easily understood. The units are provided with the same reference characters as those in FIGS. 3 to 5.

As schematically shown in FIG. 6, when the cam 438 changes to a posture of the pressing state and pushes up the pressing member 433, the pressing member 433 compresses the compression spring 432 via the second spring contact member 435. Repulsion force against the compression of the compression spring 432 is received by the first spring contact member 434 and transmitted to the first screw holding section 431*b* through the first adjustment screw 436. The rotating member supporting section 431 presses, with this force, the pressing roll 42 to the heating roll 41.

A compression amount of the compression spring 432 is determined by the position of the first spring contact member 434 that moves according to the rotation of the first adjustment screw 436 and the position of the second spring contact member 435 that moves according to the rotation of the second adjustment screw 437. The first spring contact member 434 moves in the compression and expansion direction W of the compression spring 432. However, the second spring contact member 435 moves in the inclined direction V inclined with respect to the compression and expansion direction W. Therefore, a change in the compression amount of the compression spring 432 with respect to the rotation of the second adjustment screw 437 is small as compared with a change due to the rotation of the first adjustment screw 436. Therefore, the first adjustment screw 436 serving as an adjustment screw for rough adjustment and the second adjustment screw 437 serving as an adjustment screw for fine adjustment are compatible with each other.

When the structure in which the position of the pressing roll with respect to the heating roll is adjusted by the rotation of the screw arranged obliquely to the pressing surface for supporting the pressing roll disclosed in Japanese Patent Application Laid-Open No. 7-319314 is applied to the structure in which the compression length of the spring is adjusted by the dial attached to the bolt extending in the compression and expansion direction of the spring disclosed in Japanese Patent Application Laid-Open No. 8-12526, one of the adjustment of the force of the pressing roll and the adjustment of the position of the pressing roll is dominant and the functions of the adjustment by both the structures cannot be realized. In the fixing device 40 according to this embodiment, the first adjustment screw 436 serving as an adjustment screw for rough adjustment and the second adjustment screw 437 serving as an adjustment screw for fine adjustment are compatible with each other.

This concludes the description based on the schematic drawings. Subsequently, the operations of the rough adjustment and the fine adjustment of the pressing mechanism shown in FIGS. 3 to 5 will be described below.

Figure 7:
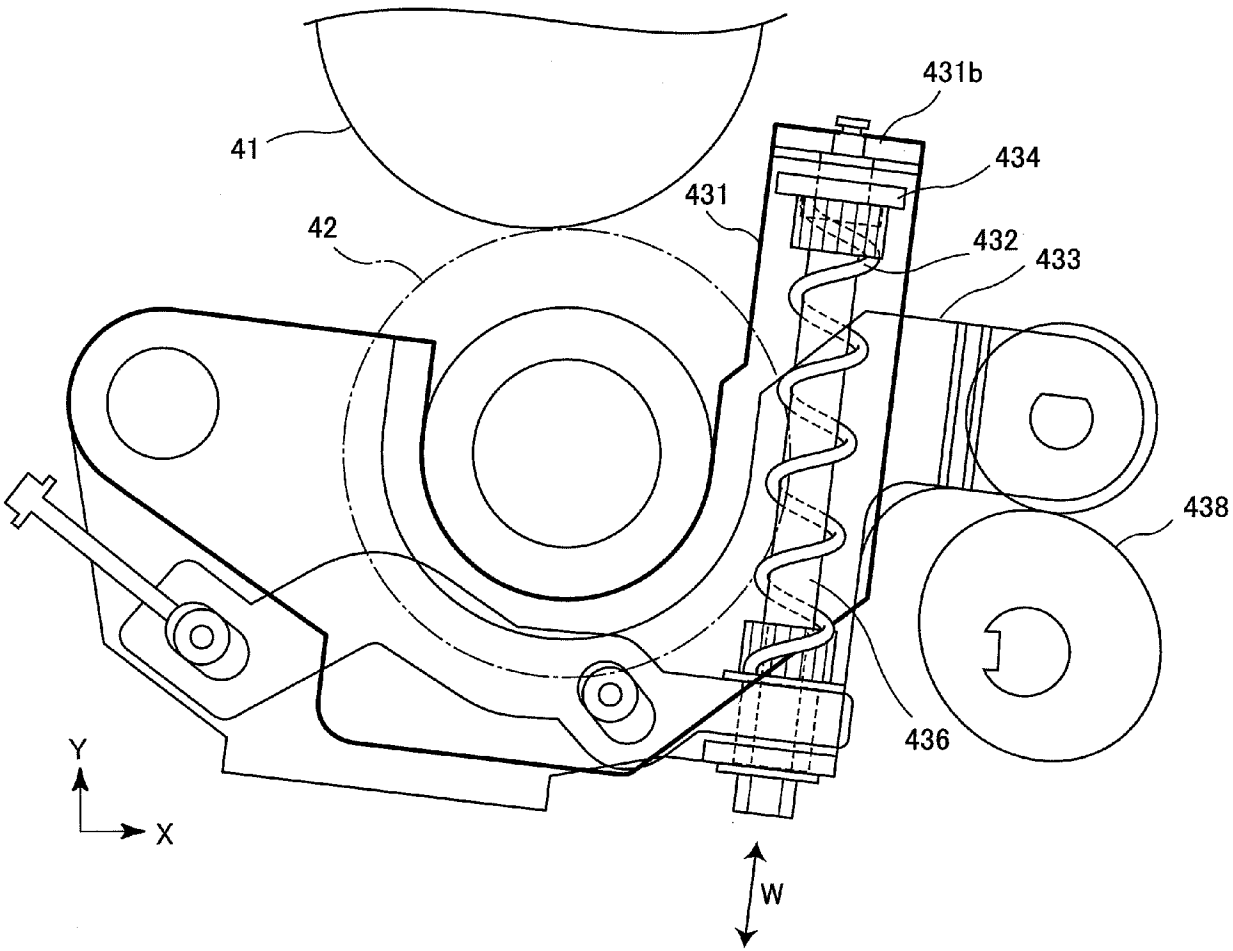
FIG. 7 is a diagram for explaining rough adjustment and fine adjustment of the pressing mechanism shown in FIGS. 3 to 5.
Figure 8:
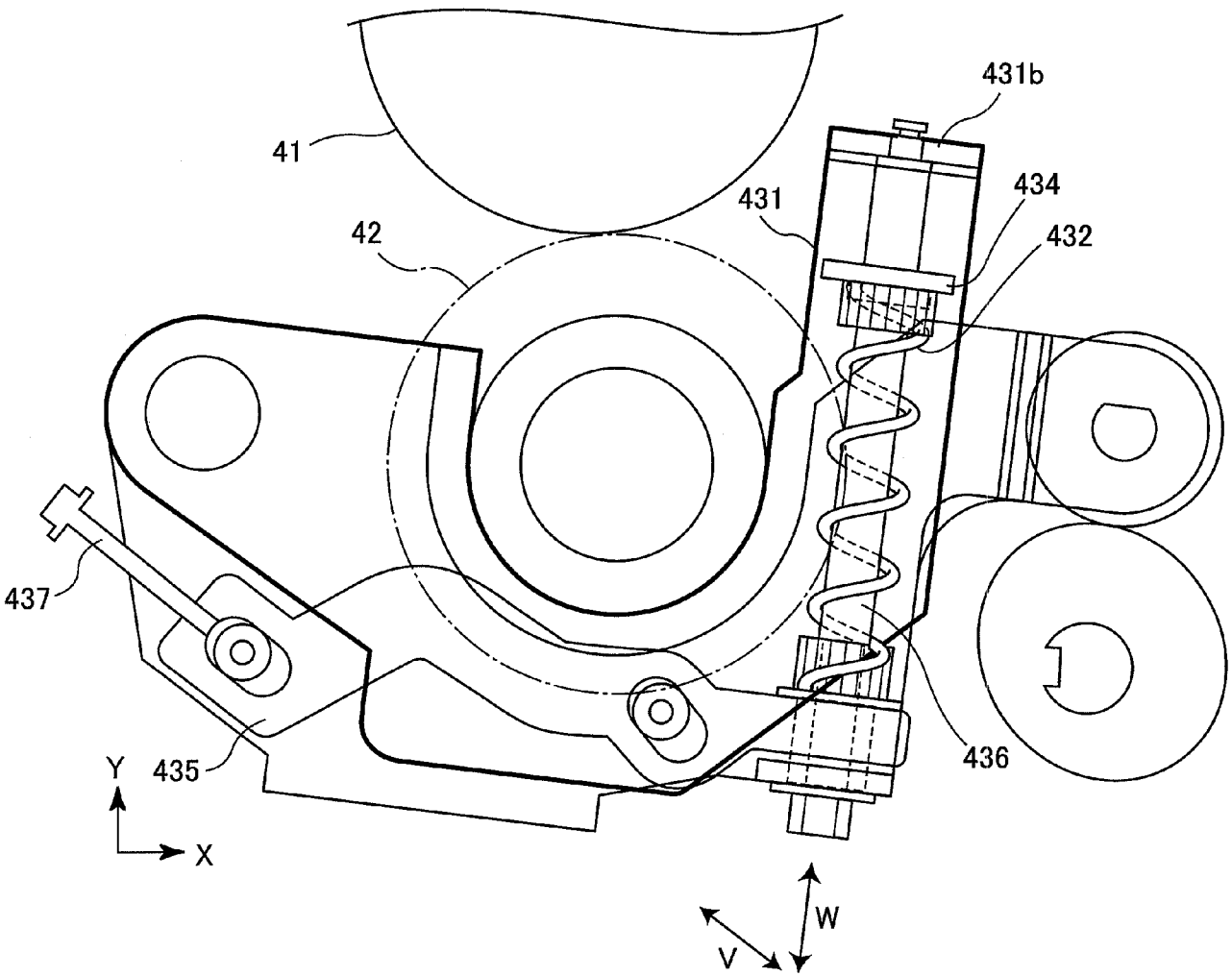
FIG. 8 is a diagram for explaining the operation of the rough adjustment of the pressing mechanism.
Figure 9:
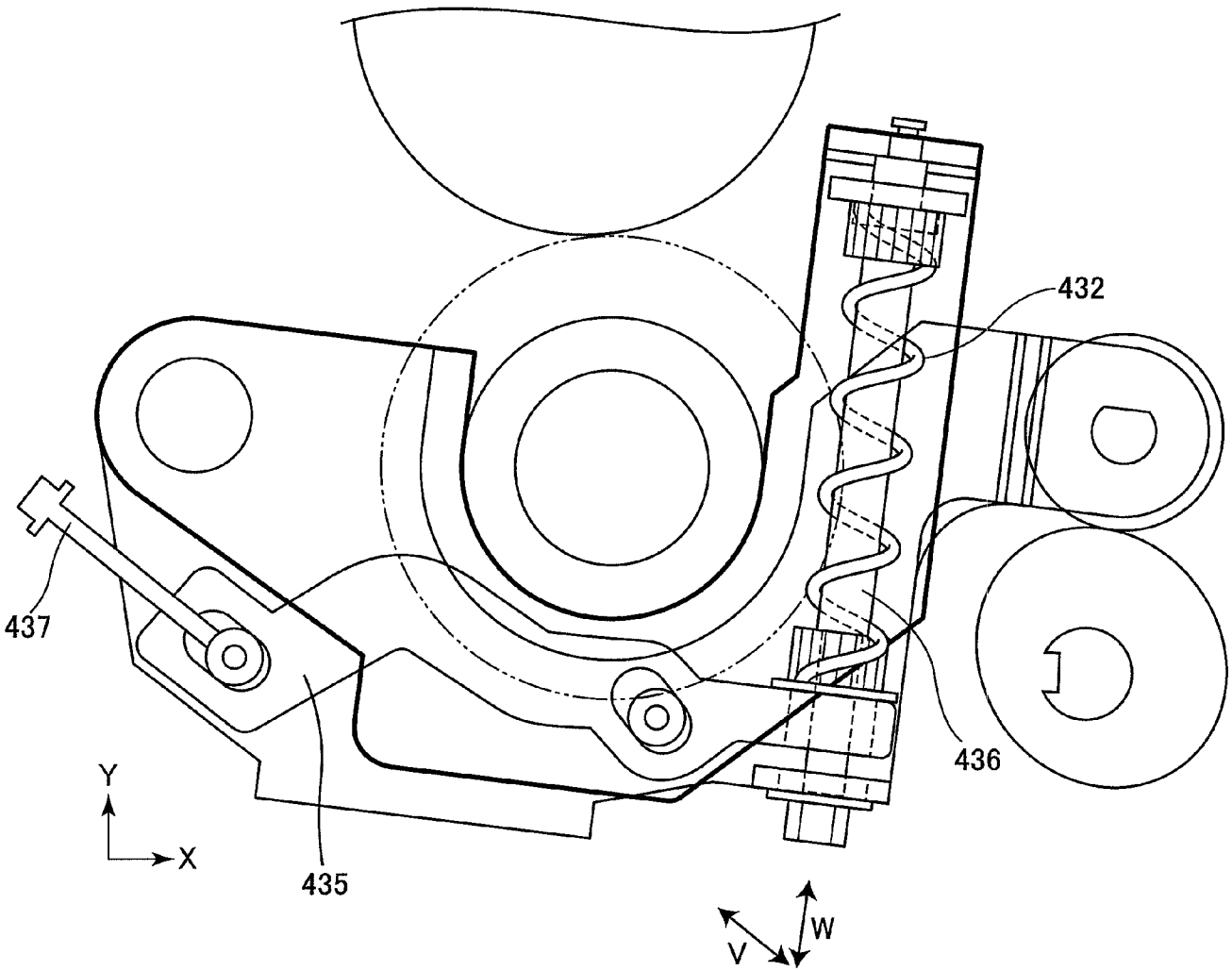
FIG. 9 is a diagram for explaining the operation of the fine adjustment of the pressing mechanism.

FIGS. 7, 8, and 9 are diagrams for explaining the operations of the rough adjustment and the fine adjustment of the pressing mechanism shown in FIGS. 3 and 5. In FIGS. 7, 8, and 9, the pressing mechanism 43 in the pressing position where the cam 438 pushes up the pressing member 433 is schematically shown. First, the rough adjustment will be described.

In a state shown in FIG. 7, when the first adjustment screw 436 is rotated by a tool such as a driver, the first spring contact member 434 in which the first adjustment screw 436 is screwed moves in the compression and expansion direction according to the rotation of the first adjustment screw 436. FIG. 8 is a diagram of a state in which the first spring contact member 434 is moved in a direction for compressing the compression spring 432 by the rotation of the first adjustment screw 436 from the state shown in FIG. 7. The first spring contact member 434 compresses the compression spring 432, thereby force of the compression spring 432 pushing up the rotating member supporting section 431 is increased via the first spring contact member 434, the first adjustment screw 436, and the first screw holding section 431*b*.

Subsequently, the fine adjustment will be described below.

In the state shown in FIG. 7, when the second adjustment screw 437 is rotated by a tool such as a driver, the second spring contact member 435 in which the second adjustment screw 437 is screwed moves in the inclined direction V according to the rotation of the second adjustment screw 437. FIG. 9 is a diagram of a state in which the second spring contact member 435 is moved by the rotation of the second adjustment screw 437 from the state shown in FIG. 7. The compression spring 432 is compressed by an amount corresponding to a component of the compression and expansion direction W inclined with respect to the inclined direction V of a movement amount in the inclined direction V of the second spring contact member 435.

Therefore, while a movement amount of the first spring contact member 434 by the rotation of the first adjustment screw 436 directly contributes to a compression amount of the compression spring 432, in the second adjustment screw 437, a compression amount of the compression spring 432 with respect to a movement amount of the second spring contact member 435 is relatively small and therefore, the fine adjustment is performed. Since the pitch of the thread of the second adjustment screw 437 is smaller than the pitch of the thread of the first adjustment screw 436, a compression amount of the compression spring 432 per rotation angle of the second adjustment screw 437 is smaller by an amount of a difference of the screw pitches than a compression amount of the compression spring 432 per rotation angle of the first adjustment screw 436. Therefore, an adjustment amount by the second adjustment screw 437 is fine as compared with an adjustment amount by the first adjustment screw 436.

When the width of the nip region N (see FIG. 2) is actually adjusted, first, the first adjustment screw 436 is rotated to roughly adjust pressing force and then the second adjustment screw 437 is rotated to finely adjust the pressing force.

The first adjustment screw 436 faces the compression and expansion direction W close to a direction in which the heating roll 41 and the pressing roll 42 are arranged. The second adjustment screw 437 is inclined with respect to the compression and expansion direction W and faces a sheet conveying direction as compared with the direction of the first adjustment screw 436. Therefore, even when there is no space for placing the fixing device 40 on the slider 7A (see FIG. 1) and inserting a tool for rotating the first adjustment screw 436, for the second adjustment screw 437, a free space for inserting a tool is secured near the sheet conveying path. Therefore, before the fixing device 40 is mounted on the copying machine 1 in a manufacturing process or the like, the first adjustment screw 436 is rotated and the pressing force is roughly adjusted. After the fixing device 40 is attached to the slider 7A (see FIG. 1) and, for example, shipped, the second adjustment screw 437 is rotated and the pressing force is finely adjusted without the fixing device 40 being removed from the slider 7A.

Incidentally, in the exemplary embodiment, the pressing roll is described as an example of the first rotating member in the present invention and the heating roll is described as an example of the second rotating member in the present invention. However, the present invention is not limited to this example. For instance, the first rotating member may be the heating roll and the second rotating member may be the pressing roll.

Further, in the exemplary embodiment, the second adjustment screw 437 extending in the inclined direction V is described as an example of the second adjustment screw in the present invention. However, in the present invention, as long as the second spring contact member only is movable in the inclined direction, the second adjustment screw may, for example, extend while deviating from the inclined direction. In the exemplary embodiment, the second spring contact member 435, in which the long hole having the cam surface F extending in the inclined direction, is described as an example of the second spring contact member of the present invention. However, in the present invention, as long as the second spring contact member is movable in the inclined direction, the second spring contact member may be moved only by thread feed of the second adjustment screw extending in the inclined direction.

Furthermore, in the exemplary embodiment, the first spring contact member 434, in which the first adjustment screw 436 is screwed, is described as an example of the first spring contact member. However, the present invention is not limited to this example. For instance, the adjustment screw may be screwed into the first screw holding section 431*b* and rotatably held with respect to the first spring contact member.

Still furthermore, in the example described in the exemplary embodiment, the thread at the pitch smaller than the pitch of the thread of the first adjustment screw 436 is formed in the second adjustment screw 437. However, the present invention is not limited to this example. For instance, the pitch of the thread of the second adjustment screw and the pitch of the thread of the first adjustment screw may be the same.

Moreover, in the exemplary embodiment, the color copying machine is described as an example of the image forming apparatus. However, the image forming apparatus in the present invention is not limited to this example and may be, for example, a monochrome copying machine, a printer, or a facsimile.

In the exemplary embodiment, the sheet made of paper is described as an example of the recording medium in the present invention. However, the recording medium in the present invention is not limited to this example and may be, for example, a sheet made of resin.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a first rotating member that extends along a rotation center line and rotates around the rotation center line;

a second rotating member that extends side by side with the first rotating member, sandwiches in cooperation with the first rotating member a recording medium on which a toner image is formed, and rotates together with the first rotating member to thereby fix the toner image on the recording medium;

a rotating member supporting section that supports the first rotating member in a state in which the first rotating member is rotatable, the rotating member supporting section being movable in a direction in which the first rotating member moves close to and away from the second rotating member;

a compression spring that pushes, with repulsion force against compression, the rotating member supporting section in the direction in which the first rotating member moves close to the second rotating member;

a pressing member that presses the compression spring to the rotating member supporting section and compresses the compression spring;

a first spring contact member that is set in contact with one end of the compression spring and movable in a compression and expansion direction of the compression spring with respect to the rotating member supporting section to which force received from the compression spring is transmitted;

a first adjustment screw that adjusts a position of the first spring contact member with respect to the rotating member supporting section;

a second spring contact member that is set in contact with the other end opposed to the one end of the compression spring and movable in an inclined direction, which is inclined with respect to the compression and expansion direction of the compression spring, with respect to the pressing member that receives force transmitted from the pressing member and pushes the compression spring with the force transmitted from the pressing member; and a second adjustment screw that adjusts a position of the second spring contact member with respect to the pressing member.

2. The fixing device according to claim 1, wherein the first adjustment screw is a screw which is screwed into the first spring contact member, which extends in the compression and expansion direction of the compression spring, and to which a force received by the first spring contact member is transmitted, and the fixing device further comprises a first screw holding section to which one end of the first adjustment screw is pressed by the force transmitted to the first adjustment screw, which holds the one end in a state where the first adjustment screw is rotatable, and which is fixed to the rotating member supporting section.

3. The fixing device according to claim 1, wherein the second adjustment screw is a screw which is screwed into the second spring contact member, which extends in the inclined direction, and to which a force received by the second spring contact member is transmitted, and the fixing device further comprises a second screw holding section to which one end of the second adjustment screw is pressed by the force transmitted to the second adjustment screw, which holds the one end in a state in which the second adjustment screw is rotatable, and which is fixed to the pressing member.

4. The fixing device according to claim 1, wherein the second spring contact member has an inclined surface extending in the inclined direction, and the fixing device further comprises a guide section fixed to the pressing member, the guide section coming into contact with the inclined surface and guiding the second spring contact member in a direction along the inclined surface.

5. An image forming apparatus comprising:

a toner image forming unit that forms a toner image on a recording medium;

a first rotating member that extends along a rotation center and rotates around the rotation center;

a second rotating member that extends side by side with the first rotating member, sandwiches in cooperation with the first rotating member the recording medium on which the toner image is formed by the toner image forming unit, and rotates together with the first rotating member to thereby fix the toner image on the recording medium;

a rotating member supporting section that supports the first rotating member in a state in which the first rotating member is rotatable, the rotating member supporting section being movable in directions in which the first rotating member moves close to and away from the second rotating member;

a compression spring that pushes, with repulsion force against compression, the rotating member supporting section in the direction in which the first rotating member moves close to the second rotating member;

a pressing member that presses the compression spring to the rotating member supporting section and compresses the compression spring;

a first spring contact member that is set in contact with one end of the compression spring and movable in a compression and expansion direction of the compression spring with respect to the rotating member supporting section to which force received from the compression spring is transmitted;

a first adjustment screw that adjusts a position of the first spring contact member with respect to the rotating member supporting section;

a second spring contact member that is set in contact with the other end opposed to the one end of the compression spring and movable in an inclined direction, which is inclined with respect to the compression and expansion direction of the compression spring, with respect to the pressing member that receives force transmitted from the pressing member and pushes the compression spring with the force transmitted from the pressing member; and a second adjustment screw that adjusts a position of the second spring contact member with respect to the pressing member.

6. The image forming apparatus according to claim 5, wherein force received by the first spring contact member screwed into the first spring contact member and extending in the compression and expansion direction of the compression spring is transmitted to the first adjustment screw, and the fixing device further comprises a first screw holding section fixed to the rotating member supporting section, the first screw holding section holding one end of the first adjustment screw in a state in which the first adjustment screw whose one end is pressed by the force transmitted to the first adjustment screw is rotatable.

7. The image forming apparatus according to claim 5, wherein force received by the second spring contact member screwed into the second spring contact member and extending in the inclined direction is transmitted to the second adjustment screw, and the fixing device further comprises a second screw holding section fixed to the pressing member, the second screw holding section holding one end of the second adjustment screw in a state in which the second adjustment screw whose one end is pressed by the force transmitted to the second adjustment screw is rotatable.

8. The image forming apparatus according to claim 5, wherein the second spring contact member has an inclined surface extending in the inclined direction, and the fixing device further comprises a guide section fixed to the pressing member, the guide section coming into contact with the inclined surface and guiding the second spring contact member in a direction along the inclined surface.

* * * * *